US009572742B2

(12) United States Patent
Chadwick

(10) Patent No.: US 9,572,742 B2
(45) Date of Patent: Feb. 21, 2017

(54) RELAXATION DEVICE

(71) Applicant: Jack Larry Chadwick, Bradenton, FL (US)

(72) Inventor: Jack Larry Chadwick, Bradenton, FL (US)

( * ) Notice: Subject to any disclaimer, the term of this patent is extended or adjusted under 35 U.S.C. 154(b) by 91 days.

(21) Appl. No.: 14/597,561

(22) Filed: Jan. 15, 2015

(65) Prior Publication Data

US 2016/0206494 A1 Jul. 21, 2016

(51) Int. Cl.

| | |
|---|---|
| ***A61H 1/00*** | (2006.01) |
| ***A47D 9/02*** | (2006.01) |
| ***A47C 21/00*** | (2006.01) |
| ***A61H 37/00*** | (2006.01) |

(52) U.S. Cl.

CPC ..... *A61H 1/005* (2013.01); *A47C 21/006* (2013.01); *A47D 9/02* (2013.01); *A61H 37/00* (2013.01); *A61H 2201/0142* (2013.01); *A61H 2201/1215* (2013.01); *A61H 2201/1418* (2013.01); *A61H 2203/0443* (2013.01)

(58) Field of Classification Search

CPC ..... A61H 1/005; A47D 9/02; A47C 21/006

See application file for complete search history.

(56) References Cited

U.S. PATENT DOCUMENTS

| | | | | |
|---|---|---|---|---|
| 3,022,520 | A * | 2/1962 | Finger | A47D 9/02 5/109 |
| 4,638,516 | A * | 1/1987 | Vrzalik | A61G 7/002 5/611 |
| 6,620,117 | B1 * | 9/2003 | Johnson | A61H 1/005 601/84 |
| 6,698,020 | B1 | 2/2004 | Zigmond et al. | |
| 6,820,640 | B2 | 11/2004 | Hand et al. | |
| 6,944,877 | B1 | 9/2005 | Lord et al. | |
| 7,211,058 | B1 * | 5/2007 | Chung | A61H 1/003 601/101 |
| 8,758,281 | B2 | 6/2014 | Biggie et al. | |
| 8,763,029 | B1 | 6/2014 | Haberman et al. | |
| 2010/0280549 | A1 | 11/2010 | Yen | |
| 2014/0100503 | A1 | 4/2014 | Liao | |

* cited by examiner

*Primary Examiner* — Charles A Marmor, II
*Assistant Examiner* — Carrie R Dorna
(74) *Attorney, Agent, or Firm* — Dinsmore & Shohl LLP

(57) ABSTRACT

A relaxation device comprising: a resting platform having a generally planar surface; a frame assembly supporting the resting platform; the frame assembly having at least one rail extending along an axis oriented along the width of the resting platform; a frame support for supporting the frame assembly above the ground, the frame support having a rail guide extending along an axis oriented along the width of the resting platform, the at least one rail slidably mounted to the rail guide; and a cam assembly having a cam, a cam arm, a cam guide and a motor, the cam guide fixedly mounted to the at least one rail, the cam guide having a slot extending orthogonal to the at least one rail, the slot defining a cam path, the cam mounted to a distal end of the cam arm, the cam operatively disposed within the slot, the motor mechanically connected to the cam arm so as to rotate the cam arm, wherein the cam is moved along the cam path further moving the at least one rail between opposing ends of the rail guide so as to move the resting platform in a side-to-side manner.

16 Claims, 5 Drawing Sheets

RELAXATION DEVICE

FIELD OF THE INVENTION

A relaxation device configured to move the user from side to side is provided.

BACKGROUND OF THE INVENTION

Relaxation devices such as massage therapy beds are used to provide stimulation to the muscles while enabling the user to lie down and relax. Such devices require the use of pulsed outputs to simulate massaging of a muscle. However, such outputs may distract a user and may even cause the user physical pain. Accordingly, it remains desirable to have a relaxation device wherein the user may be swayed side to side without any outputs pulsed into the body so as to help the user enter a peaceful state of mind.

SUMMARY OF THE INVENTION

A relaxation device configured to move the user from side to side while lying down is provided. The relaxation device includes a resting platform having a generally planar surface. A frame assembly supports the resting platform. The frame assembly has at least one rail extending along an axis oriented along the width of the resting platform.

The relaxation device further includes a frame support for supporting the frame assembly above the ground. The frame support includes a rail guide extending along an axis oriented along the width of the resting platform. The rail is slidably mounted to the rail guide.

The relaxation device includes a side-to-side mechanism configured to translate a rotary output of a motor into a side to side movement of the resting platform. In one embodiment, the side-to-side mechanism is a cam assembly having a cam, a cam arm, a cam guide, and a motor. The cam guide is fixedly mounted to the rail and the cam assembly is configured to move the rail side to side along the rail guide. The cam guide has a slot extending orthogonal to the rail. The slot defines a cam path. The cam is mounted to a distal end of the cam arm. The cam arm is rotatably mounted to an output of the motor. The cam is operatively disposed within the slot and the motor rotates the cam arm so as to rotate the cam within the slot so as to travel along the cam path, moving the cam up and down along the slot wherein the rail is moved side to side along the rail guide so as to move the resting platform in a side-to-side manner.

A cam assembly for use in a relaxation device is also provided. The relaxation device is configured to move a body in a side-to-side motion. The relaxation device includes a resting platform. The resting platform has a generally planar surface and is configured to support the body of the human.

The relaxation device further includes a frame assembly. The frame assembly is configured to support the resting platform. The frame assembly includes a rail extending along an axis oriented along the width of the resting platform.

The relaxation device further includes a frame support for supporting the frame assembly above the ground. The frame support includes a rail guide extending along an axis oriented along the width of the resting platform. The rail is slidably mounted to the rail guide.

The cam assembly includes a motor, a cam arm, a cam guide, and a cam. The motor includes a rotary output. The cam arm is mechanically attached to the rotary output of the motor. The motor is configured to rotate the cam arm about the rotary output. The cam guide includes a slot. The slot defines a cam path. The slot is generally orthogonal to the axial length of the rail. The cam guide is fixedly mounted to the rail. The cam is mounted to the distal end of the cam arm. The cam is operatively disposed within the slot wherein the motor rotates the cam arm so as to push the cam against the inner wall defining the slot wherein the cam rotates so as to move along the cam path wherein the rail is slid back and forth along the rail guide so as to move the resting platform in a side-to-side manner.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

A relaxation device and a cam assembly for use in a relaxation device are provided. The relaxation device is configured to move a resting platform in a side-to-side manner so as to provide relaxation to the user. The relaxation device includes a frame assembly supporting the resting platform. The frame assembly has a rail extending along an axis oriented along the width of the resting platform. The relaxation device further includes a frame support. The frame support is configured to support the frame assembly above the ground. The frame support includes a rail guide extending along an axis oriented along the width of the resting platform. The rail is slidably mounted to the rail guide.

The relaxation device further includes a side-to-side mechanism configured to translate a rotary output of a motor into a side to side movement of the resting platform. In one embodiment, the side-to-side mechanism is a cam assembly having a cam, a cam arm, a cam guide, and a motor. The cam guide is in a fixed relationship with respect to the rail. The cam guide includes a slot extending along an axis orthogonal to the rail. The slot defines a cam path. The cam is mounted to a distal end of the cam arm. The cam is operatively disposed within the slot so as to travel the cam path. The motor is mechanically connected to the cam arm so as to rotate the cam arm. Rotation of the cam arm engages the cam with the cam slot rotating the cam and moving the cam along the cam path wherein the rail is slid side to side along the rail guide so as to move the resting platform in a side-to-side manner.

Figure 1:
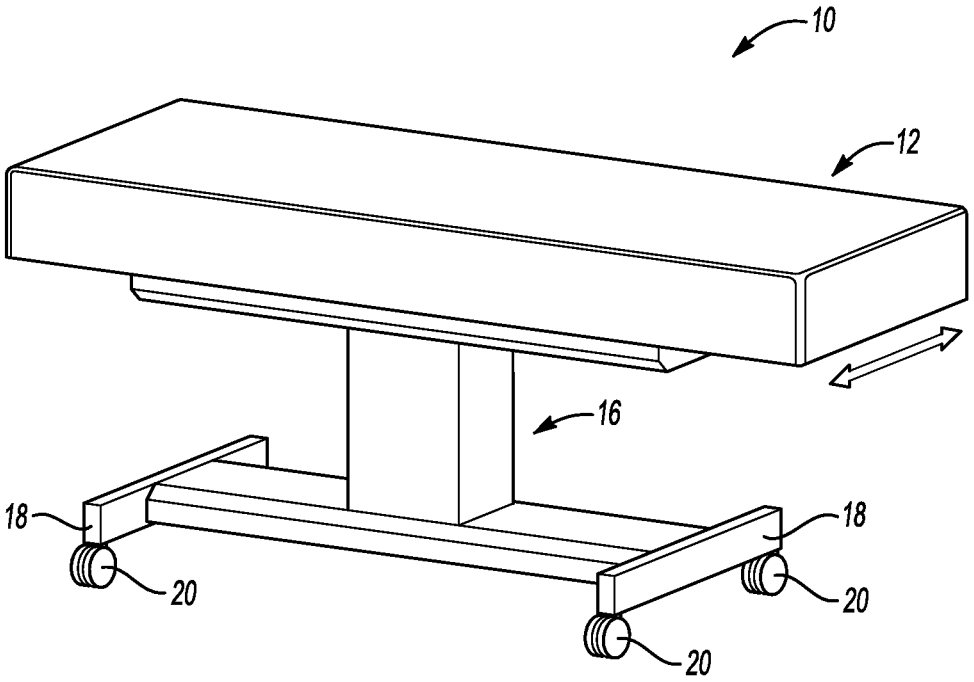
FIG. 1 is a perspective view of the relaxation device.
Figure 2:
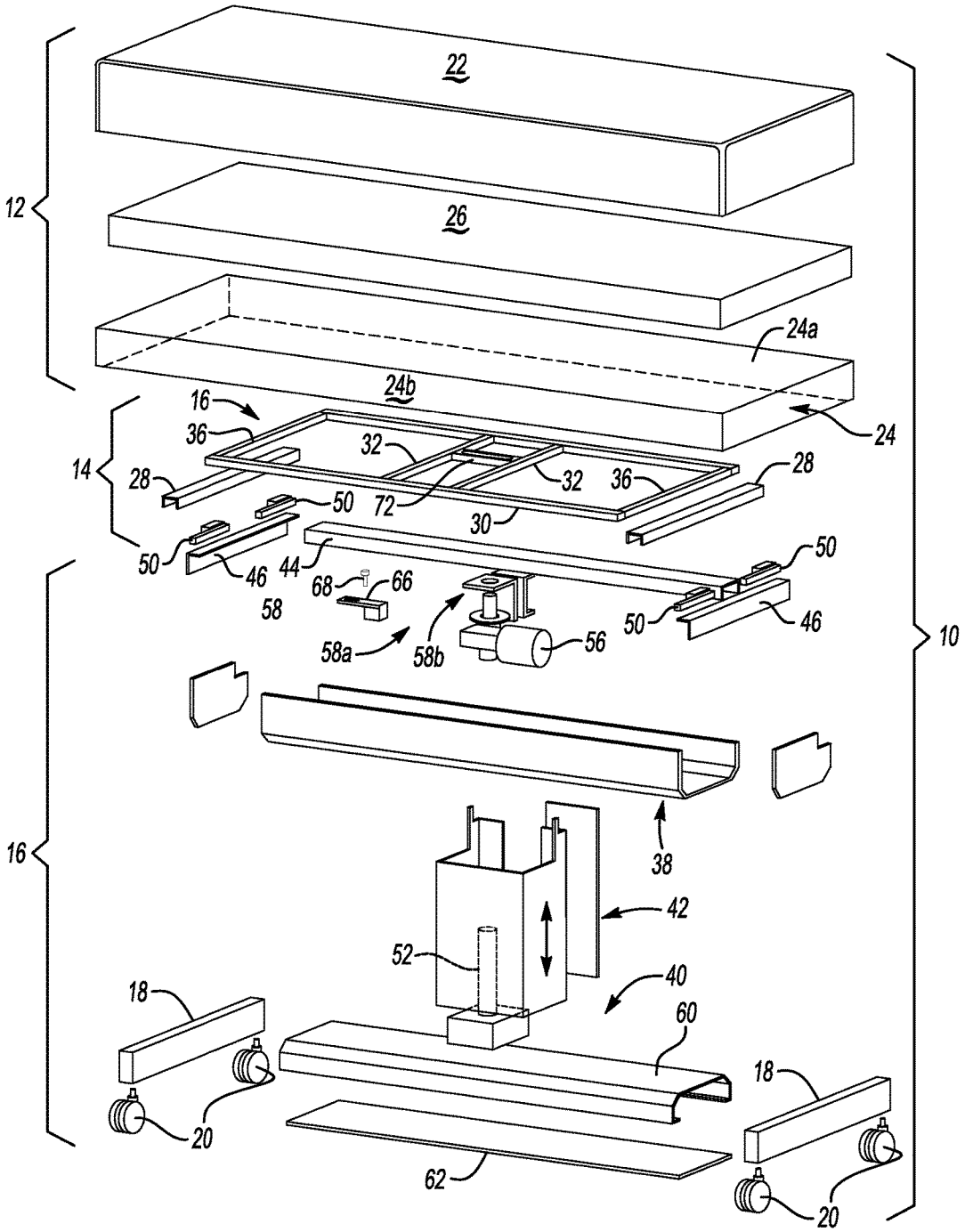
FIG. 2 is an exploded view of FIG. 1.

With reference first to FIG. 1, an illustrative embodiment of the relaxation device 10 is provided. The relaxation device 10 includes a resting platform 12. The resting platform 12 is mounted onto a frame assembly 14 which is shown in FIG. 2. The frame assembly 14 is attached to a frame support 16. The frame support 16 includes a pair of legs 18. Each of the pair of legs 18 may include a pair of wheels 20 so as to allow the user to easily move the relaxation device 10 from one place to another. As indicated by the arrow in FIG. 1, the resting platform 12 is configured to move along a side-to-side manner generally simulating the rocking of a ship.

With reference now to FIG. 2, an exploded view of the relaxation device 10 shown in FIG. 1 is provided. The resting platform 12 includes a cushion layer 22, a box 24 and a top cushion 26. The cushion layer 22 may be formed of durable material which may be easily cleaned off such as vinyl. The box 24 may be made of a durable and rigid material such as wood, metal, or plastic. The box 24 includes a top support 24*a* and a peripheral wall 24*b*. The top support 24*a* support the top cushion 26. The top cushion 26 may be a foam padding, and is covered by the cushion layer 22. The peripheral wall 24*b* bounds the frame assembly 14 so as to protect the frame assembly 14 during movement. The cushion layer 22 is configured to cover the top cushion 26 and drape over the peripheral wall 24*b* of the box 24.

The resting platform 12 is fixedly mounted to the frame assembly 14. The frame assembly 14 supports the resting platform 12 and includes at least one rail 28 extending along an axis oriented along the width of the resting platform 12. As shown in FIG. 2, the relaxation device 10 includes a pair of rails 28 each disposed on opposite ends of the frame support 16. The rails 28 are elongated and have a generally U-shaped cross section.

The frame support 16 includes an outer member 30 bounding a rectangular space. The frame support 16 may include a pair of cross members 32 spaced apart from each other extending between opposite sides of the outer member 30 and traversing the width of the resting platform 12. The frame support 16 may further include a pair of transversal support members 36. The transversal support members 36 are spaced apart from the respective cross members 32 and respective end portions of the outer member 30. The rails 28 are shown spaced apart from the frame assembly 14, but it should be appreciated that the rails 28 may be integrally formed to the frame assembly 14. The rails 28 are shown as a pair of longitudinal bars having a U-shaped cross section and may be fixedly mounted to respective transversal support members 36.

The relaxation device 10 further includes a frame support 16. The frame support 16 includes a first base 38 and a second base 40. A neck 42, which is generally upright, is fixedly mounted to the second base 40 and supports the first base 38 in suspension above the second base 40. The first base 38 includes a longitudinal support member 44. The longitudinal support member 44 is shown as a rectangular bar. The longitudinal support member 44 extends along the longitudinal axis of the resting platform 12 and is generally centered along the width of the platform.

A pair of rail guide supports 46 are fixedly mounted to opposing ends of the longitudinal support member 44. The rail guide supports are a rigid elongated member and is illustratively shown as an L-shaped cross section. The rail guides 48 may be fixedly mounted to the rail guide supports 46. The rail guides 48 may include a pair of rail bearings 50 so as to facilitate sliding of the rails 28 with respect to the rail guides 48. The longitudinal support members 44 and the rail guides 48 may be fixedly mounted to a first base 38. The rail bearings 50 are spaced apart from each other. The rail 28 as a length sufficient to maintain contact with both of the rail bearings 50 when moved side to side. The first base 38 is a generally U-shaped bracket formed of a durable and rigid material such as steel. The first base 38 extends longitudinally along the length of the resting platform 12 and is fixed with respect to the sliding frame assembly 14.

The relaxation device 10 further includes a side-to-side mechanism 58*a*. The side-to-side mechanism 58*a* is configured to translate a rotary output 56A of the motor 56 into a side to side movement of the resting platform 12. Specifically, the side-to-side mechanism 58*a* is configured to translate a rotation of the rotary output in one direction, either clockwise or counter clockwise into a side to side movement of the resting platform 12 along a generally fixed plane.

In a preferred embodiment, the side-to-side mechanism 58*a* is a cam assembly 58*b*. The cam assembly 58*b* includes a cam arm 66, a cam guide 72, and a cam 68. The cam arm 66 is configured to attach to the rotary output 56A. The rotary output rotates the cam arm 68 in a continuous direction. The cam 68 is fixedly mounted to a distal end of the cam arm 66 and is engaged within the cam guide 72 so as to follow a cam path 70*a*, wherein the rail 28 are slid back and forth along the rail bearings 50. It should be appreciated that the embodiment of the side-to-side mechanism provided herein is not intended to limit the scope of the appended claims, and that other mechanisms may be used to translate the rotary output 56A of the motor 56 into a side to side movement of the resting platform 12. For instance, the side-to-side mechanism 58*a* may be a belt assembly (not shown) having a gear assembly (not shown) mounted to the rotary output 56*a* wherein a clutch assembly (not shown) may be configured to reverse the movement of the gear assembly when the resting platform reaches an end of travel to one side of the first base 38.

The neck 42 is disposed between the first base 38 and the second base 40. The neck 42 is a generally rectangular member having an open space configured to house a motor lift 52. The motor lift is configured to vertically displace the resting platform 12. In one embodiment, the motor lift 52 includes a shaft projecting upwardly and supports the motor 56. The shaft may be threaded and a bolt rotatably driven by a drive, wherein rotation of the bolt one way advances the shaft upwards and rotation of the bolt in the opposite direction lowers the shaft.

The second base 40 includes a cover 60. The cover 60 is a generally longitudinal member having a U-shaped cross section. A bottom panel 62 is mounted to a bottom portion 64 of the cover 60. The legs 18 are mounted to the ends of the cover 60 and extend along an axis generally orthogonal to the cover 60. The legs 18 may include a pair of wheels 20. The wheels 20 may be configured to have a locking mechanism wherein release of the locking mechanism allows the wheels 20 to rotate allowing the relaxation device 10 to move between different places and the locking mechanism may be engaged so as to fix the relaxation device 10 to a position.

Figure 3:
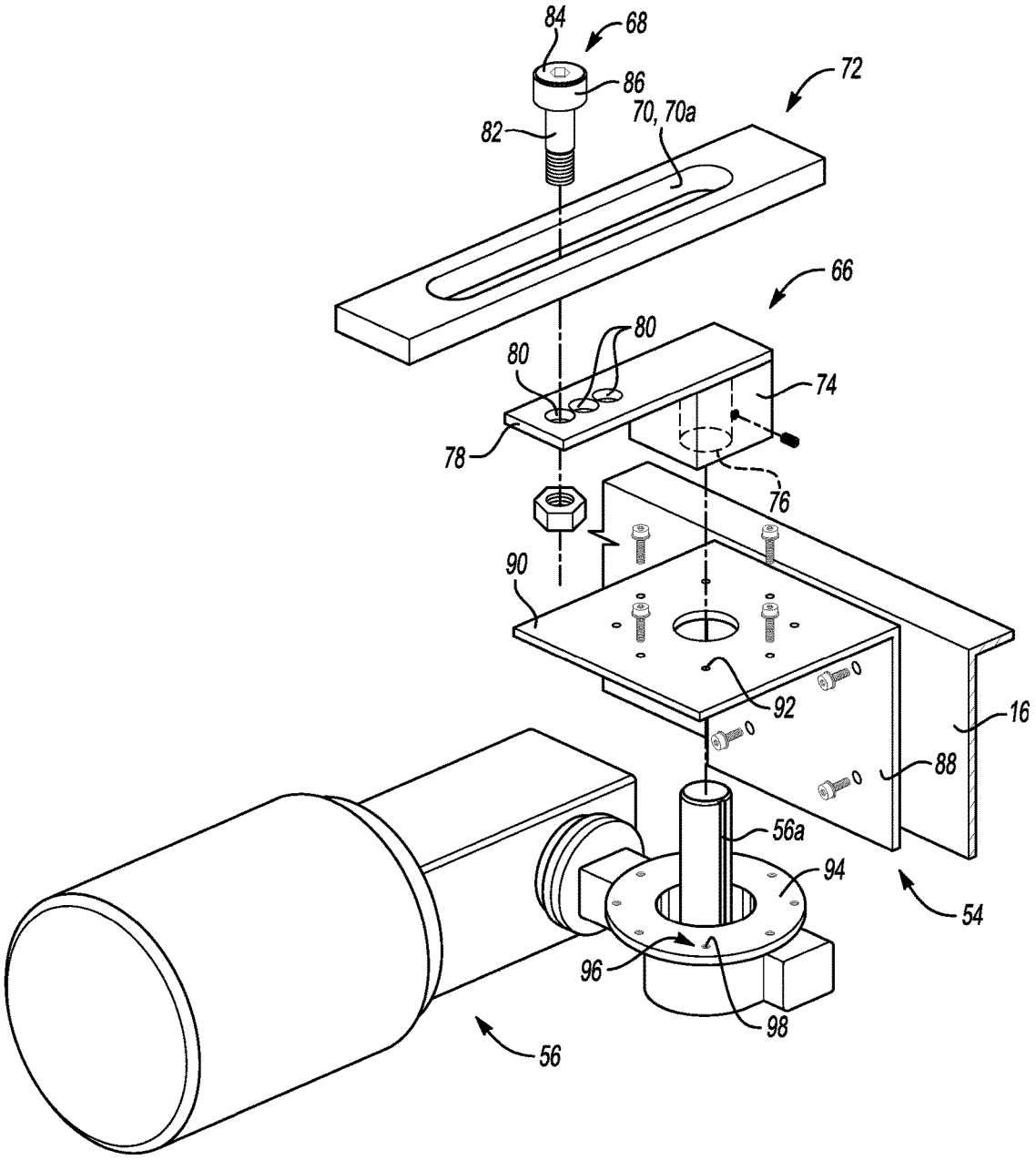
FIG. 3 is an exploded view of an embodiment of the side-to-side mechanism.

With reference now to FIG. 3, the cam assembly 58*b* is provided. FIG. 3 shows the cam arm 66, the cam guide 72, and the cam 68. The cam arm 66 has a fitting 74. The fitting 74 is a generally cubical member having a bore 76. The bore 76 is configured to receive the rotary output 56A of the motor 56. A setscrew may be engaged to bind the rotary output 56A to the fitting 74. The cam guide 72 is fixedly mounted between the cross members 32 and is generally equidistant between opposite sides of the outer member 30.

The cam arm 66 further includes a cam support 78. The cam support 78 is a generally rectangular body having a plurality of openings 80. The openings 80 are configured to set the radial distance of the cam 68 with respect to the rotary output 56A of the motor 56. The cam guide 72 is a rectangular member having a slot 70. The ends of the slot 70 are rounded and are dimensioned to fittingly receive the cam 68 so as to generate a sliding frictional engagement with the cam 68. The cam 68 includes a shaft 82 and a pin head 84. The cam 68 further includes a cam bearing 86 rotatably mounted to the pin head 84. The shaft 82 is mounted to an opening 80 of the cam support 78 and the end of the shaft 82 may be threaded so as to receive a bolt so as to secure the shaft 82 to the cam support 78. The shaft 82 includes a radial flange (not shown) configured to support the cam bearing 86 so as to prevent the cam bearing 86 from slipping off the cam pin 82.

As shown, the fitting 74 is fixedly mounted to the rotary output 56A of the motor 56 and the shaft 82 of the cam 68 is engaged in one of the openings 80 of the cam support 78. A nut is engaged to the threaded end of the shaft 82 so as to secure the cam 68 to the cam support 78 wherein the bearing may be rotated about the pin head 84.

FIG. 3 also shows the motor support 54. The motor support 54 includes a first panel 88. The first panel 88 is configured to attach to the frame support 16. The first panel 88 is orthogonal to a second panel 90. The second panel 90 is configured to attach to the motor 56. The second panel 90 includes a plurality of holes 92 through which a screw may be inserted so as to attach the motor support to the frame support 16. The second panel 90 is disposed along a plane generally parallel to the planar surface 12*a* of the resting platform 12.

The motor 56 includes a rotary output 56A and a cylindrical collar 94 having through-hole 96. The cylindrical collar 94 is fixedly mounted to the motor 56 and the rotary output 56A extends and projects through the through-hole 96 of the cylindrical collar 94. A plurality of threaded openings 98 are provided for securing the second panel 90 to the cylindrical collar 94. The holes 80 of the second panel 90 are aligned to the threaded openings 98. Screws may be used to engage the threaded openings 98 so as to secure the second panel 90 to the cylindrical collar 94 thereby securing the motor 56 to the motor support 54 as shown in FIG. 3.

With reference now to FIGS. 4A-4E, the operation of the cam assembly 58*b* is provided. The operation of the cam assembly 58*b* will be explained using the position of a two handed clock. The position of the cam 68 relates to the position of the minute arm of the two handed clock, with 12 o'clock referencing the top of the resting platform 12. For use herein, the "top" of the resting platform 12 refers to the center of the end portion of the resting platform 12 where a person's head would rest. Naturally, 6 o'clock would refer to the center of the end portion of the resting platform 12 where a person's feet would rest. FIGS. 4A-4E show the progression of the resting platform 12 moving side to side as the cam assembly 58*b* operates.

Figure 4A:
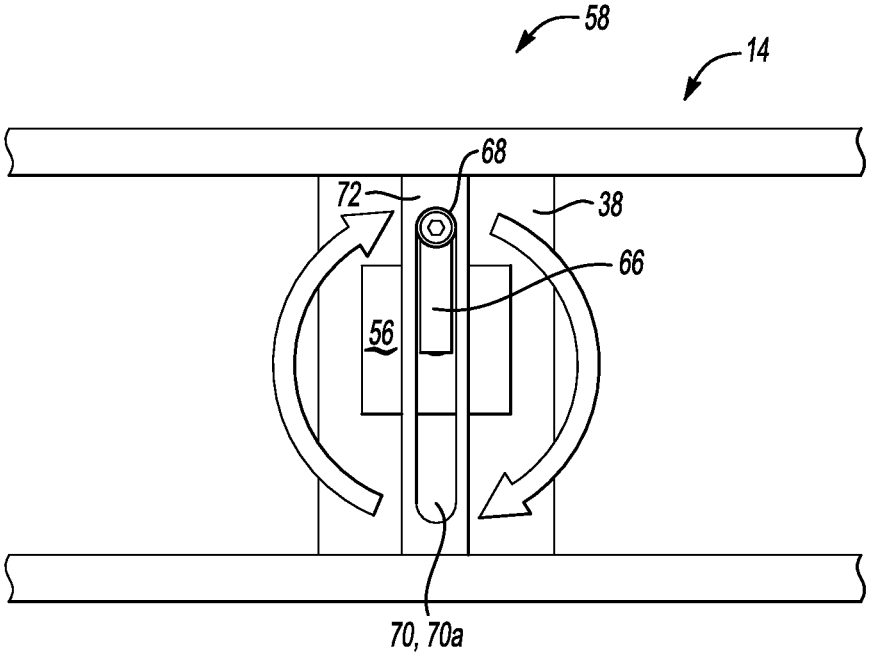
FIG. 4A is a close-up view showing the cam assembly wherein the cam is in the 12 o'clock position.

With reference first to FIG. 4A, the cam assembly 58*b* is shown in the 12 o'clock position. In the 12 o'clock position, the cam arm 66 is generally aligned along the longitudinal axis of the first base 38 and the frame assembly 14 is generally centered with respect to the first base 38. FIG. 4A shows the cam 68 positioned along an upper end of the slot 70. The slot 70 defines a cam path 70*a* for which the cam 68 travels.

Figure 4B:
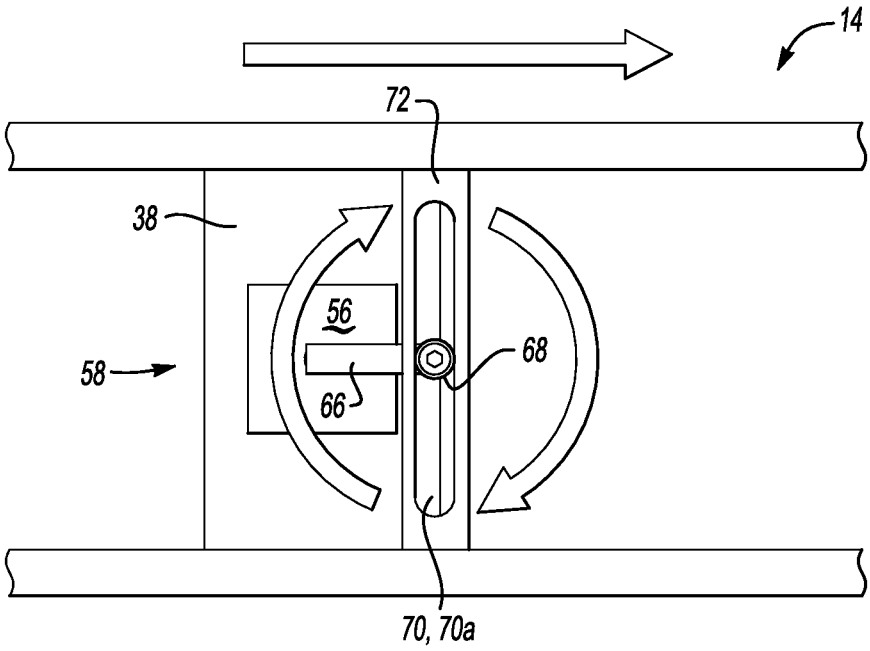
FIG. 4B is a view of FIG. 4A showing the cam in the 3 o'clock position.

With reference now to FIG. 4B, the rotary output 56A of the motor 56 turns the cam arm 66 clockwise about 90 degrees so as to place the cam 68 in the 3 o'clock position wherein the cam 68 is generally centered with respect to the slot 70. However, the resting platform 12 has moved to the right, as indicated by the arrow, of the first base 38 relative to the position shown in FIG. 4A.

Figure 4C:
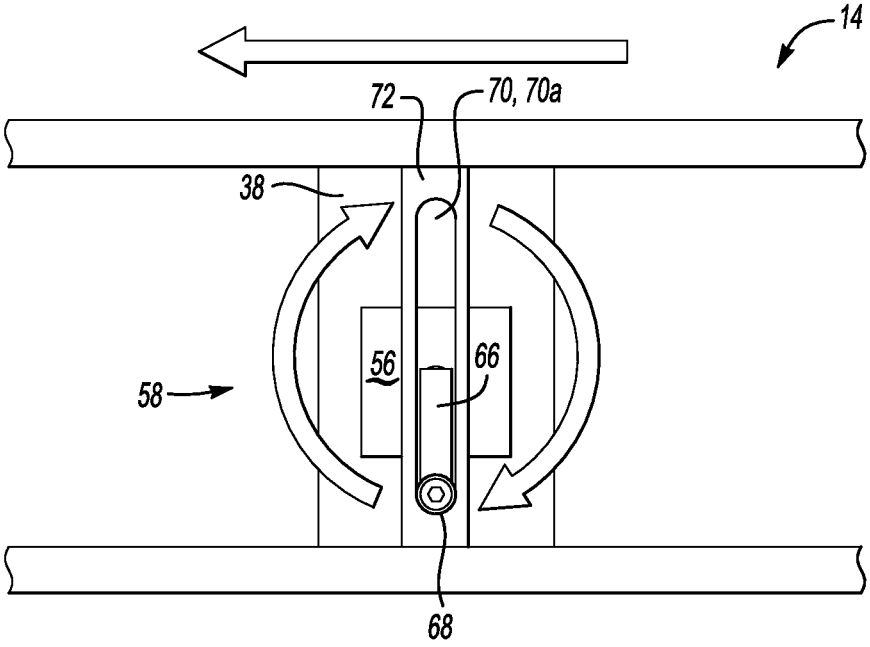
FIG. 4C is a view of FIG. 4B showing the cam at the 6 o'clock position.

With reference now to FIG. 4C, the rotary output 56A has further rotated, rotating the cam arm 66 another 90 degrees and positioning the cam 68 towards the bottom end of the slot 70 in the 6 o'clock position. The resting platform 12 has moved to the left, as indicated by the arrow, of the first base 38 relative to the position shown in FIG. 4B. In the 6 o'clock position the frame assembly 14 is again generally centered with respect to the first base 38.

Figure 4D:
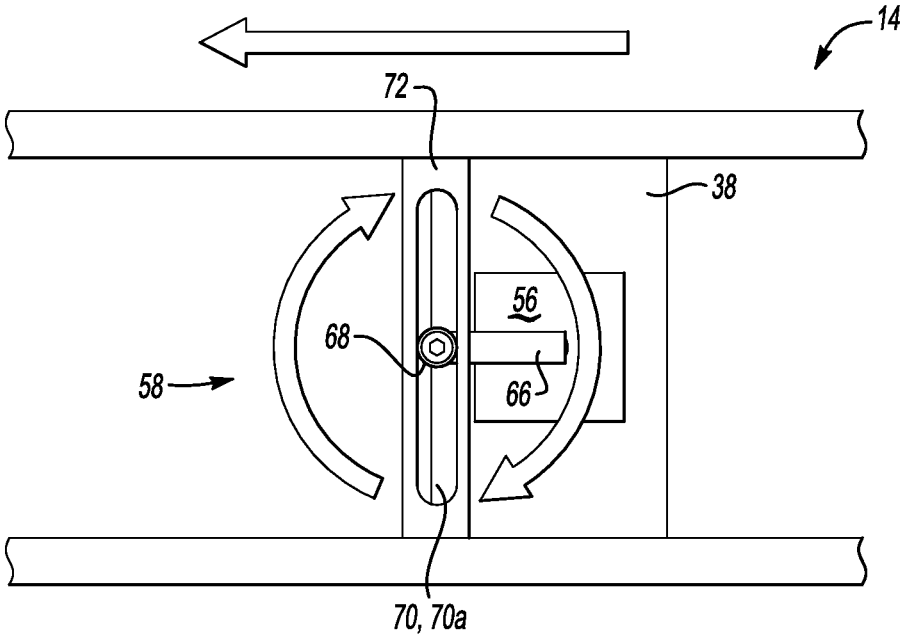
FIG. 4D is a view of FIG. 4C showing the cam progressing to the 9 o'clock position.
Figure 4E:
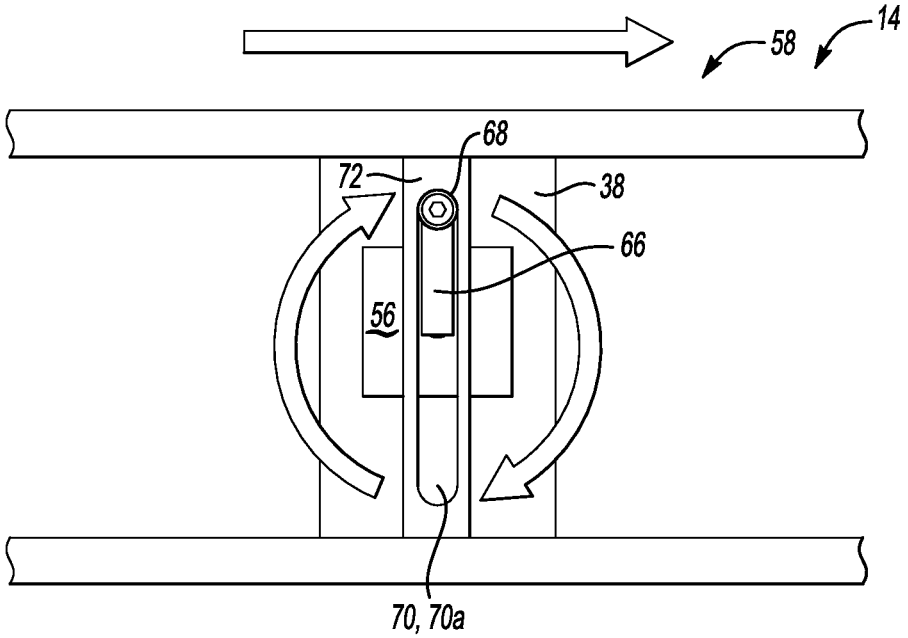
FIG. 4E is a view of FIG. 4D showing the cam progressing back to the 12 o'clock position.

With reference now to FIG. 4D, the cam arm 66 is shown at the 9 o'clock position wherein the rotary output 56A has again turned the cam arm 66 clockwise about 90 degrees. The frame assembly 14 is shown moved furthest to the left of the center of the first base 38. In the 9 o'clock position, the resting platform 12 has moved to the left of the first base 38, thus achieving the side to side motion.

With reference now to FIG. 4E, the cam arm 66 is again rotated by the rotary output 56A and moves the cam 68 back to the 12 o'clock position wherein the frame assembly 14 and the resting platform 12 are moved to the right relative to the position shown in FIG. 4D and are again centered with respect to the first base 38. Thus, the motor 56 and the cam assembly 58*b* move the bed from side to side providing a comforting motion to the resting body.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. For instance, the motor 56 is shown as a DC motor with double reduction. However, other motors having a rotary output may be adapted and used herein. Further, the cam is shown as a cam pin 82 having a cam bearing 86 which is generally round in cross section. However, it should be appreciated that other cam shapes may be used herein. For instance, the cam may be a square nut rotatably mounted to the pin head.

The invention claimed is:

1. A relaxation device comprising:

a resting platform having a generally planar surface;

a frame assembly supporting the resting platform, the frame assembly having at least one rail extending along an axis oriented along the width of the resting platform;

a frame support for supporting the frame assembly above the ground, the frame support having a rail guide extending along an axis oriented along the width of the resting platform, the at least one rail slidably mounted to the rail guide;

a motor having a rotary output; and a side-to-side mechanism, the side-to-side mechanism operatively connected to the rotary output and the frame assembly, the side-to-side mechanism translating the rotation of the rotary output into a side to side movement of the frame assembly so as to move the at least one rail side to side along the rail guide, wherein the side-to-side mechanism is a cam assembly having a cam, a cam arm orthogonal to the cam, and a cam guide, the cam guide fixedly mounted to the at least one rail, the cam guide having a slot extending orthogonal to the cam, the slot defining a cam path, the cam path directing the cam along an axis, the cam path being generally orthogonal to the cam and parallel to the at least one rail, the cam operatively disposed within the slot so as to travel along the axis defined by the cam path, the cam arm fixedly mounted to the rotary output so as to rotate the cam arm, wherein the cam is moved along the cam path further moving the at least one rail between opposing ends of the rail guide so as to move the resting platform in a side-to-side manner.

2. The relaxation device as set forth in claim 1 wherein the at least one rail is a pair of rails, each of the pair of rails is parallel to the other.

3. The relaxation device as set forth in claim 2, wherein the frame support includes a first base and a second base, the first base having a longitudinal support member, each of the pair of rail guides disposed on respective opposite ends of the longitudinal support member.

4. The relaxation device as set forth in claim 3, wherein the frame support includes a neck, the neck is generally an upright member, one end of the neck is fixedly mounted to the second base and the other end of the neck is fixedly mounted to the first base.

5. The relaxation device as set forth in claim 4, wherein the second base includes a pair of legs, one of the pair of legs is disposed on one end of the second base and the other of the pair of legs is disposed on the other end of the second base.

6. The relaxation device as set forth in claim 5, wherein each of the pair of legs is oriented along an axis generally orthogonal to a longitudinal axis of the second base.

7. The relaxation device as set forth in claim 5, further including a first pair of wheels and a second pair of wheels, the first pair of wheels mounted on one of the pair of legs and the second pair of wheels mounted on the other of the pair of legs.

8. The relaxation device as set forth in claim 3, wherein the frame support includes a motor support, the motor support fixing the motor with respect to the first base.

9. The relaxation device as set forth in claim 1, wherein the resting platform is a bed, having a cushion top.

10. The relaxation device as set forth in claim 1, wherein the frame assembly includes an outer member bounding a rectangular space, and a pair of cross members spaced apart from each other, the cross members extending between opposite sides of the outer member and generally parallel to the at least one rail, the cam guide interconnecting the pair of cross members.

11. The relaxation device as set forth in claim 1, further including a motor lift, the motor lift mounted to the frame support and configured to vertically displace the resting platform.

12. A cam assembly for use in a relaxation device, the relaxation device configured to move a human in a side-to-side motion, the relaxation device having a resting platform, the resting platform being generally planar and configured to support the body of the human, the relaxation device further including a frame assembly supporting the resting platform; the frame assembly having at least one rail extending along an axis oriented along the width of the resting platform, and a frame support for supporting the frame assembly above the ground, the frame support having a rail guide extending along an axis oriented along the width of the resting platform, the at least one rail slidably mounted to the rail guide, the cam assembly comprising:

a motor;

a cam arm mechanically attached to the motor, the motor configured to rotate the cam arm;

a cam guide having a slot extending orthogonal to the cam and being generally parallel to the at least one rail, the cam guide fixedly mounted to the at least one rail, the slot defining a cam path, the cam path extending along an axis and being generally orthogonal to the axial length of the at least one rail;

and a cam, the cam mounted to a distal end of the cam arm, the cam is generally orthogonal to the cam arm and is operatively disposed within the slot, the motor rotating the cam arm, wherein the cam is moved along the cam path further moving the at least one rail between opposing ends of the rail guide so as to move the resting platform in a side-to-side manner.

13. The cam assembly as set forth in claim 12, wherein the motor includes a rotary output, the cam arm includes a fitting and a cam support, the cam support having a hole configured to support the cam, the fitting fixedly mounted to the rotary output.

14. The cam assembly as set forth in claim 13, wherein the cam includes a cam pin having a shaft and pin head, and a cam bearing rotatably mounted to the pin head, the shaft mounted within the hole.

15. The cam assembly as set forth in claim 13, wherein the fitting is orthogonal to the cam support.

16. The cam assembly as set forth in claim 12, further including a motor support, the motor support having a first panel configured to attach to the frame support and a second panel configured to attach to the motor so as to fix the motor to the frame support.

* * * * *